US005515942A

United States Patent [19]

Woodfield

[11] Patent Number: 5,515,942

[45] Date of Patent: May 14, 1996

[54] LADDER STILES AND LADDERS PRODUCED THEREFROM

[75] Inventor: Bruce H. Woodfield, Palmerston North, New Zealand

[73] Assignee: Palmerston Extension Ladder Company Limited, Palmerston North, New Zealand

[21] Appl. No.: 245,061

[22] Filed: May 17, 1994

Related U.S. Application Data

[63] Continuation of Ser. No. 858,127, Mar. 26, 1992, abandoned.

[30] Foreign Application Priority Data

Mar. 26, 1991 [NZ] New Zealand ..... 237590

[51] Int. Cl.[6] ..... E06C 1/00; E06C 7/00

[52] U.S. Cl. ..... 182/46; 182/194

[58] Field of Search ..... 182/46, 194, 207

[56] References Cited

U.S. PATENT DOCUMENTS

| | | | |
|---|---|---|---|
| 433,547 | 6/1882 | Johansson . | |
| 2,862,650 | 12/1958 | Scott et al. | 182/194 X |
| 2,885,132 | 5/1959 | Campbell | 182/46 |
| 2,966,229 | 12/1960 | Frezieres | 182/46 X |
| 2,982,373 | 5/1961 | Hopfeld | 182/46 |
| 3,158,224 | 11/1964 | Van Name et al. | 182/46 |
| 3,193,051 | 7/1965 | Dosker | 182/46 |
| 3,490,188 | 1/1970 | Troutner | 52/644 |
| 3,734,237 | 5/1973 | Howard . | |
| 3,999,628 | 12/1976 | Parson | 182/46 |

(List continued on next page.)

FOREIGN PATENT DOCUMENTS

| | | | |
|---|---|---|---|
| 0043805 | 1/1982 | European Pat. Off. . | |
| 1390396 | 1/1965 | France | 182/46 |
| 2408448 | 6/1979 | France . | |
| 2472072 | 12/1979 | France . | |
| 2457005 | 6/1976 | Germany | 182/46 |
| 115429 | 8/1925 | Switzerland . | |
| 249335 | 6/1946 | Switzerland . | |
| 478330 | 9/1969 | Switzerland . | |
| 0606760 | 11/1978 | Switzerland | 182/46 |
| 1198638 | 7/1970 | United Kingdom | 182/194 |
| 2065211 | 6/1981 | United Kingdom . | |
| WO86/06315 | 11/1986 | WIPO . | |

OTHER PUBLICATIONS

*West German Patent Abstracts,* Week T27, Building, Mining, Mechanical Handling, p. 2, regarding German Patent Publication No. DE 2053100 (29 Oct. 1970).

*West German Patent Abstracts,* Week W48, Blinds; Shutters; Ladders, p. 14, regarding German Patent Publication No. DE 2507761 (20 Nov. 1975).

*West German Patent Abstracts,* Week B14, Buildings; Construction, p. 4, regarding German Patent Publication No. DE 2741936 (29 Mar. 1979).

*West German Patent Abstracts,* Week B14, Buildings; Construction, pp. 1–2, regarding German Patent Publication No. DE 3828749 (1 Mar. 1990).

*Dialog™ Database Abstract,* World Patent Index (WPI), Files 350–351, 2 pages total, regarding German Patent Publication No. DE 4023426 (6 Feb. 1992).

*Patent Abstracts of Japan,* ABS vol. 14, No. 91, ABS Publication Date: Feb. 20, 1990, 1 page total, regarding Japanese Patent Publication No. 01–301492 (5 Dec. 1989).

*Patent Abstracts of Japan,* ABS vol. 10, No. 375, ABS Publication Date: Dec. 13, 1986, 2 pages total, regarding Japanese Patent Publication No. 61–166790 (28 Jul. 1986).

*Primary Examiner*—Karen J. Chotkowski

[57] ABSTRACT

The invention is directed to strong, lightweight, electrically non-conducting ladder stiles and ladders formed therefrom. Each ladder stile comprises a tension and compression portion structurally interconnected by a spacing portion. The spacing portion has a cross section which varies over the length of the stile between sections where the entire spacing portion is the full width of the stile and sections where at least part of the spacing portion is less than the full width of the stile. The ladders of the invention are formed of two ladder stiles interconnected by rungs.

8 Claims, 5 Drawing Sheets

U.S. PATENT DOCUMENTS

| | | | |
|---|---|---|---|
| 4,029,172 | 6/1977 | Green | 182/46 |
| 4,191,000 | 3/1980 | Henderson | 52/729 |
| 4,195,462 | 4/1980 | Keller et al. | 52/690 |
| 4,244,760 | 1/1981 | Smith . | |
| 4,336,678 | 6/1982 | Peters | 52/729 |
| 4,413,459 | 11/1983 | Lambuth | 52/729 |
| 4,677,806 | 7/1987 | Tuomi | 52/729 X |
| 4,852,322 | 8/1989 | McDermid | 52/729 X |
| 5,163,532 | 11/1992 | McCarty | 182/46 |

LADDER STILES AND LADDERS PRODUCED THEREFROM

This application is a continuation of application Ser. No. 07/858,127, filed Mar. 26, 1992 and now abandoned.

TECHNICAL FIELD

This invention relates to ladder stiles and ladders formed therefrom. In particular, it relates to strong, lightweight, non-conducting ladders and ladder stiles.

BACKGROUND

This invention relates to ladder stiles and ladders produced therefrom.

Timber ladders are the traditional form of ladders used by man since he first descended from trees with the aid of supple vines. These traditional forms of ladders are however subject to a number of drawbacks, the main ones being excessive weight, increasing difficulty of supply of the accepted timbers, the tendencies of the customary timbers to wear on the top and bottom edges of the ladder stiles, and electrical conductivity.

Timber ladders, because of the nature of the materials of which they are constructed, have always been the subject of an excessive weight disadvantage. This weight disadvantage is particularly pronounced in the case of one person portable wooden ladders.

In recent years aluminium and fibreglass composite ladders have been developed to overcome this weight disadvantage. Examples of such ladders are disclosed in FR 2472072, EP 43805, and GB 2065211. Such ladders incorporate their own disadvantages of electrical conductivity and poor weathering capacity respectively.

The weight problem with timber ladders has traditionally been addressed by reducing the cross sectional sizes of the timber members of the ladder and particularly the stiles. An example of such a ladder is provided in U.S. Pat. No. 3734237. However, when it is considered that reducing the depth of the ladder stile has a deleterious effect on the stiffness and strength of that stile according to a logarithmic scale, it will readily be appreciated that a small reduction in the depth of a ladder stile has a larger effect on that stile's stiffness and strength. When it is further considered that the centre of the ladder stile is drilled out to accept the ends of the ladder rungs, it will be readily appreciated that further reductions in the depth of the stile of the ladders is impractical because it becomes dangerous.

Similarly, the thickness of the ladder stiles cannot be further reduced because it is the depth of the housing of the rungs into the stiles which gives the ladder its diagonal bracing, its resistance to twist and its overall structural integrity.

Accordingly, thinner section timber ladders are subject to the drawbacks of being weaker overall structures which only partially solve the excessive weight problem.

Another difficulty associated with the production of timber ladder stiles is that over the years some species of timbers suitable for the manufacture of timber ladder stiles have been felled to extinction in most growing areas and are therefore unavailable for supply to manufacturers and the end user. The timber which is nowadays most used, at least in the Pan Pacific region, for the manufacture of ladders is Douglas Fir, commonly known by its trade name Oregon. Only the virgin forest timber is suitable for ladder stiles, the regrowth, or second crop timber being unsuitable owing to fast growth (weak timber), cross grain and many knots.

This timber is also now becoming difficult to procure owing to the rapidly diminishing resource of virgin forest and also the closure of remaining forests for the protection of local flora and fauna. Moreover, the increasing difficulty of supplying the accepted timbers is a problem which the passage of time will only exacerbate. It has therefore become necessary for manufacturers of timber ladders to find alternatives to these traditional timbers.

The traditional timbers used for the manufacture of timber ladders are soft woods and therefore by their very nature, prone to wear on the top and bottom surfaces of the stiles in situations of moderate or constant use. Also these timbers are not particularly resistant to the wearing effects of sun and rain. These timbers tend to be very stringy, which feature often operates to produce sharp splinters especially at locations of wear or damage. These undesirable features of the traditional timber ladders and especially of the stiles are further constraints to the saleability of such ladders to the public.

Traditional timber ladders also commonly include reinforcing material in the form of a rod running the length of the stile. While this reinforcing material has a moderate effect in increasing the strength and stiffness of the ladder stile, its main purpose is to act as a "safety net" in the unlikely event of a ladder stile breaking into two pieces when in use. Should this happen, the reinforcing material serves to hold the severed pieces together and to prevent the complete collapse of the ladder until such time as the user has been able to descend. Conventionally, a wire reinforcing rod is stapled into a groove on the outside edge of the ladder stile. The disadvantage with this system is that the wire can simply "unzip" by springing all the staples in quick succession.

It is accordingly, an object of the present invention to provide a ladder stile which will go some way towards overcoming the abovementioned disadvantages by providing a lightweight non-conducting ladder stile and ladders formed therefrom, or which at least provides the public with a useful choice.

SUMMARY OF THE INVENTION

Accordingly, in one aspect the present invention can be said to consist in a stile for a ladder comprising:

a compression portion bearing a compression edge and having a substantially uniform cross-section over the length of the stile, a tension portion bearing a tension edge and having a substantially uniform cross-section over the length of the stile, said compression and tension portions being spaced apart at a substantially constant distance over the length of the stile, and wherein said compression and tension edges define the width of the stile and, a spacing portion structurally interconnecting said compression and tension portions and having a cross-section which varies over the length of the stile between sections where the entire spacing portion is the full width of the stile and sections where at least part of the spacing portion is less than the full width of the stile wherein each of said compression, tension and spacing portions are formed from a non-conducting material.

In a preferred embodiment, said compression and tension edges are substantially parallel to one another.

In a second preferred embodiment, the stile is substantially rectangular in section with the compression and tension edges defining the width of the stile.

Conveniently, the variations in cross-section of the spacing portion from being the full width of the stile to less than the full width of the stile occur in a substantially regular repeating pattern over the length of the stile.

All of the portions of the stile may be formed from the same material but will preferably be formed from a number of different materials.

In one embodiment the spacing portion of the stile is itself comprised of two sections. This spacing portion may also conveniently include a resilient membrane between the two sections of the spacing portion.

In a further embodiment of the invention, the spacing portion of the stile may be comprised of more than two sections.

The ladder stiles of the present invention may also include reinforcing material.

In a further aspect, the present invention provides a lightweight, non-conducting ladder comprising two ladder stiles of the invention interconnected by rungs.

In a preferred embodiment the ladder stiles will be substantially parallel to one another.

Although the invention is broadly as defined above, it will be appreciated by those persons skilled in the art that it is not limited thereto and that it also includes embodiments of which the following description provides examples. In particular, preferred aspects of the invention will be described in relation to the accompanying drawings.

DETAILED DESCRIPTION OF THE INVENTION

Figure 2:
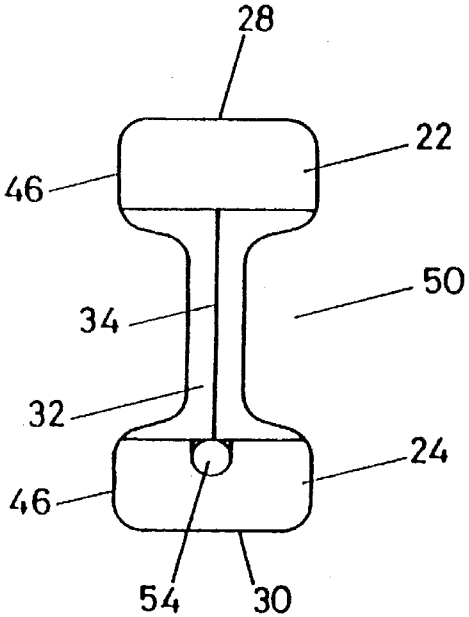
FIG. 2 is a cross section view of a first stile of the invention at a point where at least a part of the spacing portion is less than the full width of the stile.

In its primary aspect, the present invention relates to a ladder stile. Such a ladder stile is suitable for use in the production of lightweight non-conducting ladders. The stile is particularly suitable for use in the production of one person portable ladders, and also in areas where electricity may present a danger.

The ladder stile of the present invention comprises an elongate body. It is preferred that the elongate body be substantially rectangular in section as shown in the accompanying drawings. However, other appropriate shapes for the body, for example square, circular or hexagonal may be employed. It is also preferred that the ladder stile be deeper in cross section than those stiles conventionally employed in the art so as to provide a stronger, stiffer overall structure. It will be appreciated that the precise dimensions of the stile may vary substantially in length, depth and width. The ladder stile is designated generally as 20 in the accompanying drawings.

The ladder stile 20 may be made of any suitable materials or combination of materials known in the art which are non-conducting. It is preferred that the materials selected, be hard wearing and relatively light weight. In one embodiment the stile 20 may be produced from soft timbers and the completed stile 20 hardened. Examples of suitable materials for use in producing the ladder stiles 20 of the invention are hard and soft timbers, hardened soft timbers, plywoods, fibreglass pultrusions, fibre reinforced plastics and combinations of two or more materials selected from the same or different general classes of materials. Timbers particular preferred for use in the ladder stiles 20 are high quality durable timbers including ash, hickory and native New Zealand beech, and light weight timbers including pine and fir. While the ladder stile 20 may be comprised of a single material or a combination of materials, in practice a combination of materials is used. The presently preferred combination of materials is beech and pine.

The ladder stile 20 comprises three main portions, a compression portion 22, a tension portion 24 and a spacing portion 26, as illustrated in the accompanying drawings.

It will be appreciated that these portions may be distinct segments joined together, or abutting regions within a single piece of timber. It is preferred that distinct segments joined together be used.

Figure 18:
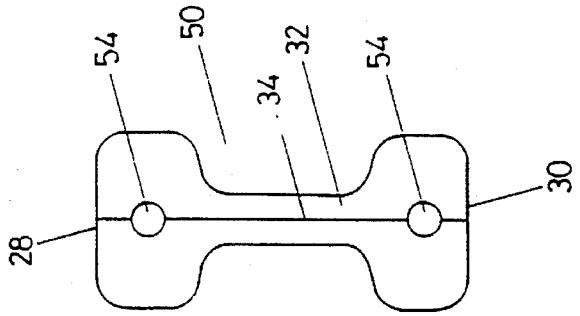
FIG. 18 is a cross section view of a seventh stile of the invention where at least a part of the spacing portion is less than the full width of the stile.
Figure 17:
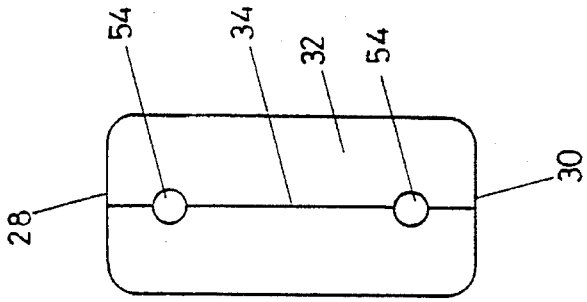
FIG. 17 is a cross section view of a seventh stile of the invention where the entire spacing portion is the full width of the stile.

By the term "compression portion" it will be understood that this is the portion of the stile disposed closest to the operator when in use. In the case of a ladder stile 20 formed from a single piece of material, or two pieces of material joined together such as is illustrated in FIGS. 17 and 18, the "compression portion" will comprise a portion of the stile equivalent to the compression portions illustrated in the other accompanying drawings.

The compression portion 22 bears a compression edge 28 and has a substantially uniform cross-section over the length of the stile. The compression portion 22 may be of any shape convenient for such a compression portion 22. Examples of suitable shapes for the compression portion 22 as viewed in plan include substantially rectangular, pentagonal, "T", "U" or staple shapes as illustrated in FIGS. 1, 2, 5 to 7, 11 to 14 and 15. In the presently preferred embodiment the shape of the compression portion 22 is substantially rectangular. It will be appreciated that the dimensions of the compression portion may vary. Generally, the width of the compression portion is between substantially 25 to 40 mm with a width of substantially 33 mm being favoured. The depth of the compression portion varies widely within the range of from substantially 10 to 30 mm. A depth of between substantially 18 to 25 mm is preferred.

It will also be appreciated that the compression portion 22 of the ladder stile 20 is a portion under stress. The materials selected for the compression portion 22 will appropriately reflect this stress factor. Materials which are not prone to splintering are also preferable. Accordingly, while any non-conducting materials may be utilised it is preferred that the compression portion 22 be comprised of hard durable timbers, hardened soft timbers, fibreglass reinforced plastics, strong composites or combinations thereof. Examples of suitable hard timbers include hickory, ash and native new Zealand beech. Native beech is the timber presently preferred.

The term "tension portion" as used herein refers to that portion of the ladder stile 20 disposed farthest away from the operator when in use. Again, in the case of a ladder stile 20 formed from a single piece of material, or two pieces of material joined together such as illustrated in FIGS. 17 and 18 the "tension portion" will comprise a portion of the stile equivalent to the tension portions illustrated in the other accompanying drawings.

The tension portion 24 bears a tension edge 30 and has a substantially uniform cross-section over the length of the stile. The tension portion 24 as with the compression portion 22, may be of any shape convenient for such a tension portion 24. While the tension and compression portions 24 and 22 respectively may have different shapes and dimensions, desirably they will be substantially the same shape and size. As with the compression portion 22 the tension portion 24 of the ladder stile 20 is stressed. Accordingly, any materials or combination of materials suitable for use in the compression portion 22 may also be employed in the tension portion 24.

While the spatial relationship between the compression edge 28 and the tension edge 30, of portions 22 and 24 respectively, may vary, it is preferred that edges 28 and 30 be substantially parallel to one another. Where the ladder stile is substantially rectangular in plan the tension and compression edges 30 and 28 define the width of the stile 20.

The third portion of the ladder stile 20 is spacing portion 26. The spacing portion 26 of the ladder stile 20 structurally interconnects the tension and compression portions 24 and 22. Interconnection may be achieved by any means known in the art including tongue and groove connection, gluing or laminating. Preferably, portions 22, 24 and 26 are glued or laminated together.

The spacing portion 26 is a relatively unstressed portion of the ladder stile 20. Accordingly, while any suitable non-conducting materials known in the art may be used in the spacing portion 26 light weight materials are generally preferred. Suitable general classes of lightweight materials include pine and fir timber, hardened soft timbers, plywoods, lightweight composites, or combinations of two or more materials selected from one or more general classes. A particularly preferred lightweight material for use in the spacing portion 26 is pine.

The spacing portion 26 has a cross-section which varies over the length of the stile 20. Preferably, the variation occurs in a substantially regular repeating pattern.

This variation in cross-section occurs between sections where substantially the entire spacing portion 26 is the full width of the stile 20 and sections where at least part of the spacing portion 26 is less than the full width of the stile 20. Accordingly, it will be appreciated that the dimensions of the cross section will vary within a broad range. Generally, the depth of the spacing portion 26 is between 35 to 55 mm and the width is between substantially 5 to 45 mm. Preferably, the depth is between substantially 40 to 50 mm and the width is between substantially 7 to 40 mm.

The shape employed for the spacing portion 26, where substantially the entire spacing portion 26 is the full width of the stile 20, may be any shape known in the art. Examples of appropriate shapes for the spacing portion 26 include rectangles, squares, hexagons, and I shapes. Of these, the spacing portion 26 will desirably be substantially rectangular in shape, as illustrated in FIGS. 1, 2, 5 to 7, 11 to 14 and 15.

The spacing portion 26 may be comprised of a single piece of timber, or two or more sections 32 which are the same or different in both shape and the materials from which they are formed. However, where two sections 32 are employed, as shown in FIGS. 1, 2, 5, 11 and 12, they will preferably be of the same shape, and formed of the same material.

Conveniently, in this embodiment, the sections 32 are joined together along a single centre line 34. The sections 32 may be joined together by any suitable means conventionally employed in the art including gluing or laminating. Where timber sections 32 are used, these sections 32 are desirably selected so as to change the direction of the timber fibres at the centre line 34. This change in direction of the fibres aids in reducing the tendency of the timber to split under stress.

Where the spacing portion 26 is comprised of two sections of material 32 the spacing portion 26 may be further provided with a resilient membrane 36 inter-connecting the sections 32. The resilient membrane 36 acts as an anti-split membrane.

Figure 5:
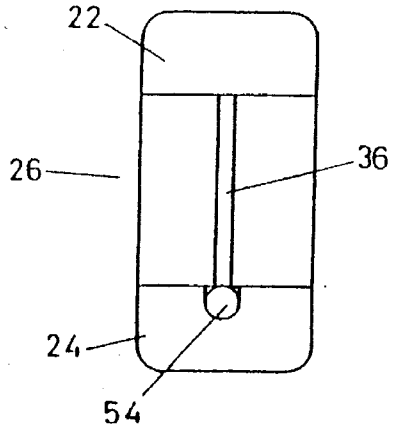
FIG. 5 is a cross section view of a second stile of the invention at a point where the entire spacing portion is the full width of the stile.
Figure 8:
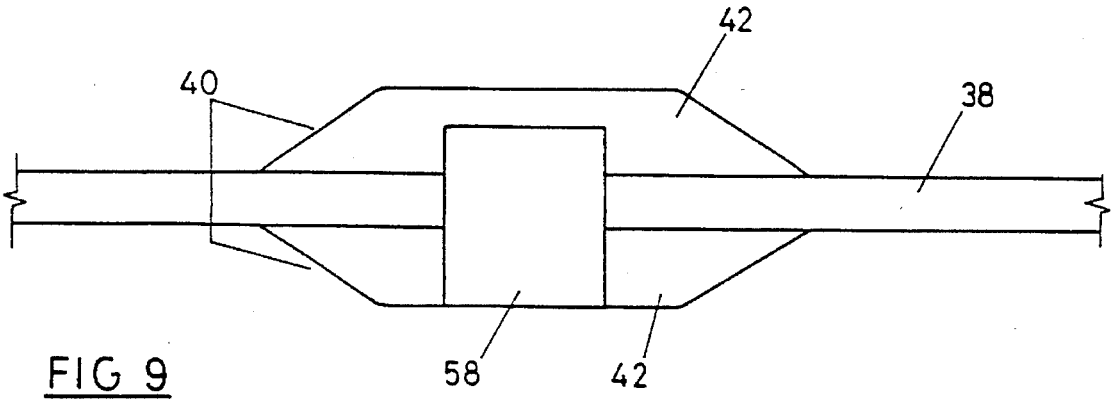
FIG. 8 is a longitudinal section through the spacing portion of a third stile of the invention.

As shown in FIG. 5 the resilient membrane 36 may extend lengthwise of the spacing portion 26 only, or may optionally be keyed to the tension and/or compression portions 24 and 22. The resilient membrane 36 may be keyed to the tension and compression portions 24 and 22 by any of the conventional means referred to above or otherwise known in the art.

The resilient membrane 36 may be made of any material known in the art which will aid in the prevention of splitting. Examples of suitable materials include but are not limited to plywood, timber veneer, fibreglass cloth and other composite materials. In the presently preferred embodiment plywood is used.

In a further embodiment of the invention the spacing portion 26 when it is substantially the full width of the stile 20, may be comprised of more than two pieces of material 32. This embodiment is illustrated in FIGS. 6 to 10 and 13 to 16 of the accompanying drawings.

In a first version, as illustrated in FIGS. 6 to 10, 13 and 14, the spacing portion 26 may be comprised of a spacer 38, and packing means 40 disposed either side of said spacer 38. The spacer 38 is an elongate member, desirably rectangular in shape, although other appropriate shapes may be employed.

The spacer 38 is connected to both the tension and compression portions 24 and 22 by such suitable means as are known in the art including gluing and laminating. The spacer 38 may be connected to the tension and compression portions 24 and 22 at any given point. Desirably however, the spacer is connected to the tension and compression portions 24 and 22 at a point substantially mid-width of each of the portions 24 and 22.

The spacer 38 may be made of any of the materials or combinations of materials set out above in relation to the stile 20. In the presently preferred embodiment the spacer 38 is made of a lightweight material such as plywood or marine plywood.

The packing means 40 of the spacing portion 26 will be substantially complementary in shape to these spaces defined between the tension and compression portions 24 and 22 and the spacer 38. Generally, the packing means 40 will not exceed the width of the stile as delimited by the tension and compression edges 30 and 28 respectively.

Figure 10:
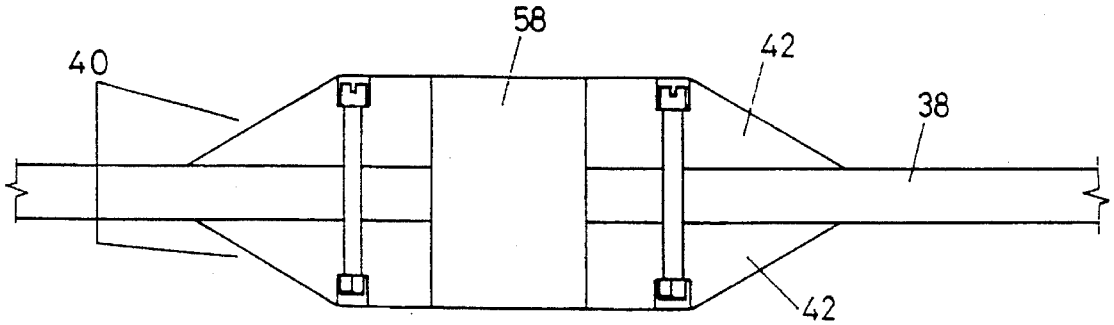
FIG. 10 is a longitudinal section through the spacing portion of a second alternate form of a third stile of the invention.

The packing means 40 may consist of a single packing unit or multiple packing units 42 disposed either side of the spacer 38. Suitable packing materials include all of those materials set out above for the stile 20 either alone or in combination. Preferably, a lightweight material such as pine or fir will be used. The packing means 40 may be joined to the tension and compression portions 24 and 22 and the spacer 38 by conventional means including gluing or laminating. In an alternate form the packing means may be connected to the spacer 38 by bolting, gluing or riveting as illustrated in FIG. 10.

Figure 15:
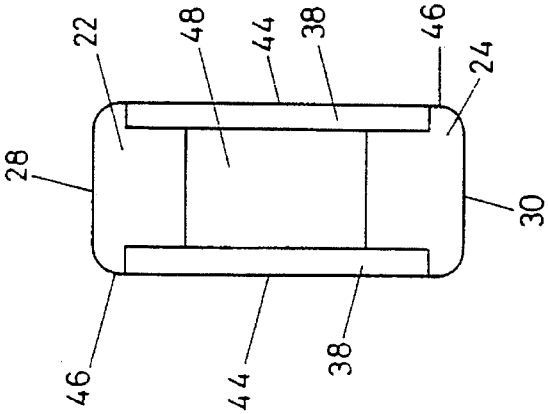
FIG. 15 is a cross section view of a sixth stile of the invention where the entire spacing portion is the full width of the stile.
Figure 16:
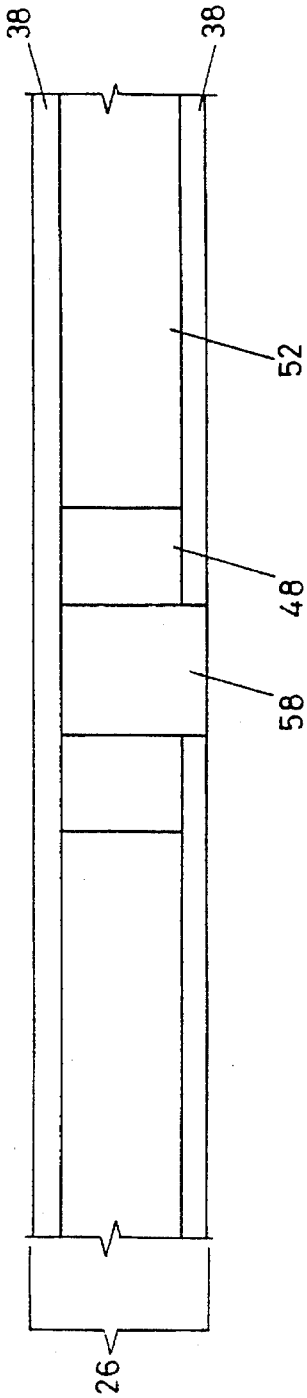
FIG. 16 is a longitudinal section through the spacing portion of a sixth stile of the invention.

In a second version, as illustrated in FIGS. 15 and 16, the spacing portion 26 may be comprised of two or more elongate spacers 38 interconnecting the tension and compression portions 24. Preferably, two spacers 38 will be used. As with the single spacer 38 version of the spacing portion 26, the two spacers 38 may be connected to the tension and compression portions 24 and 22 at any given point. Desirably however, the spacers 38 are connected in such a way that the outer edges 44 of the spacers 38 are substantially parallel to the outer edges 46 of the tension and compression portions 24 and 22. In this embodiment a separate central body 48 is defined between the spacers 38 and the tension and compression portions 24 and 22. The central body 48 comprises packing means 40 as discussed above. The body 48 may consist of one or more packing units 42 and may be made of one or more materials. The materials employed for the spacers 38 and the central body 48 may be any of the materials suitable for use in the spacers 38 and packing means 40 set out above. Similarly, the spacers 38 and central body 48 will be connected to the tension and compression portions 24 and 22, and to each other, by any conventional means already discussed.

As stated above, the spacing portion 26 also incorporates sections wherein at least a part of the spacing portion 26 is less than the full width of the stile 20. When the spacing portion 26 is comprised of one or two sections 32 the reduction of at least part of the spacing portion 26 to a width narrower than the full width of the stile 20 may be achieved by removing part or all of sections 32, and from one or more sides of the spacing portion. Desirably, a part of the sections 32 will be removed from either side of the spacing sections 32 to define recesses 50 as indicated in FIGS. 2, 4, 11, 12, 14 and 18 of the accompanying drawings. Removal of material may be achieved by any conventional means such as machining. In the preferred embodiment the shape of the recess 50 defined by removal of the material will be substantially trapezoid in plan. However, recesses 50 of alternate shapes may also be used.

Where the spacing portion 26 is comprised of a single spacer 38 and packing means 40 the reduction in width of at least a part of the spacing portion 26 to less than the full width of the stile 20 is achieved by the omission or whole or part removal of the packing means 40. Packing means 40 may be omitted or removed from either one or both sides of the spacer 38 as illustrated in FIGS. 7 to 10, 13 and 14. Desirably, the packing means will be removed from both sides of the spacer to define recesses 50. The omission or removal of the packing means may be achieved by any convenient method known in the art.

Where the spacing portion 26 is comprised of two or more spacers as illustrated in FIGS. 15 and 16 the reduction in width of at least a part of the spacing portion 26 is achieved by the omission or removal in whole or part of the central body 48 to define recess 52. Generally, for both the single and multiple spacer 38 embodiments where the tension and compression portions 24 and 22 are narrow then less packing material will be removed.

Conveniently, where a recess 52 is present that recess 52 is treated or filled with a moisture excluding agent to prevent the ingress of water into the stile 20. Any known moisture excluding agents may be used. A preferred material is a moisture excluding foam which fills the recess 52.

In a further aspect of the invention, the ladder stile 20 is additionally provided with reinforcing material as illustrated in FIGS. 1, 2, 5, 7, 17 and 18.

The reinforcing material may be provided in any suitable form known in the art such as a strip or rod running the length of the ladder stile. A reinforcing rod 54 is preferred. When a reinforcing rod 54 is present, it may be used in either the tension and compression portions 24 and 22. In the case of single ladders it is preferred that reinforcing rods be present in both the tension and compression portions 24 and 22, principally to take account of the fact that inattentive operators tend to use the ladder either way up. Preferably, a single reinforcing rod is used in the tension portion 24 of the ladder stile 20.

The reinforcing rod 54 may be located in the tension and/or compression edges 30 and/or 38 as with traditional timber ladders. Desirably however, the reinforcing rod is placed in a position internal of the tension and compression edges 30 and 28 where it is protected from wear and damage and to eliminate the problem of the reinforcing rod becoming unzipped from the stile in the case of breakage, as happens with traditional timber ladders.

Suitable reinforcing rod materials include fibreglass, strong composites, and wire. Where wire is used, it should preferably be firmly anchored to one end of the ladder stile 20 by any conventional means, and to the other end of the ladder stile 20 by means of a threaded rod with a nut attached (not shown). Such means are well known in the art. It will be appreciated that this arrangement can be used to tension the wire, and therefore stiffen the ladder stile 20, by tightening the nut on the threaded rod. The reinforcing material of preference is fibreglass rod.

The ladder stile of the invention may also incorporate rung attachment means. In one embodiment, rung receiving recesses 58 are provided in the stile 20. Desirably, rung recesses 58 will be formed only in the spacing portion 26 of the stiles 20 and only at those sections of the spacing portion 26 where substantially the entire spacing portion 26 is the full width of the stile 20. The recesses 58 may be of any shape suitable for receiving and holding a ladder rung and may be formed through any known methods such as machining.

Figure 9:
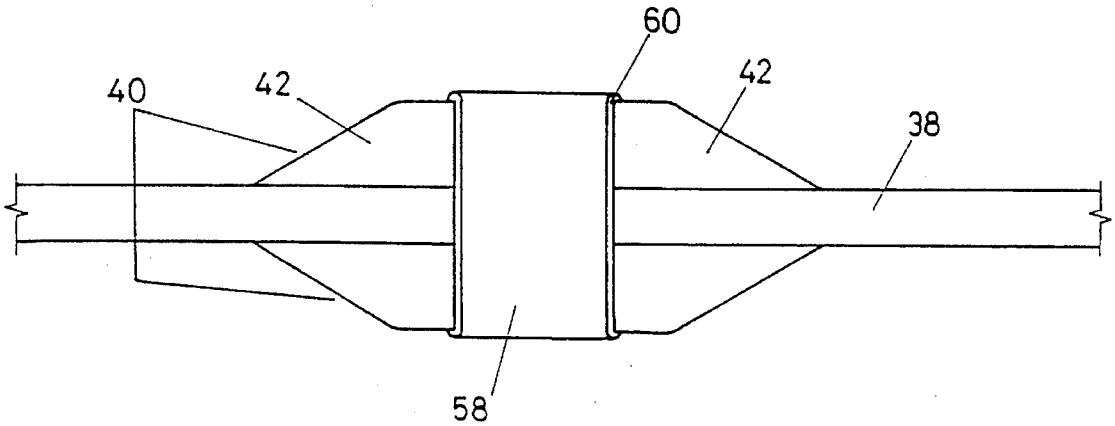
FIG. 9 is a longitudinal section through the spacing portion of an alternate form of a third stile of the invention.

The rung recesses 58 may pass through the entire width of the spacing portion as illustrated in FIGS. 9 and 10. However, it is preferred that the recesses 58 pass only partway through the spacing portion 26 and from one side only as shown in FIGS. 4, 8, 9 and 16. In this embodiment a protective material 60 may be inserted into the recess 58 as shown in FIG. 9. In particular, metal protective material may be laid over the entire width of the spacing portion 26 and attached by such means as are known in the art including gluing, riveting and screwing. Preferred protective materials include metal tubing and metal plate. In one embodiment the wood of the rung recess may be hardened using known techniques to reduce splitting of the timber.

In a further aspect the present invention relates to a lightweight non-conducting ladder comprising two stiles 20 of the invention interconnected by rungs (not shown). While other variations are possible it is preferred that the stiles 20 be substantially parallel to one another. The rungs may be of any shape conventionally employed in the art for such ladder rungs. Examples of suitable shapes as viewed in longitudinal section include circles, squares and rectangles but are not limited thereto. Presently preferred are rungs which are substantially round. Particularly preferred are round rungs with grip-ridges over the entire surface or most preferably on the upper surface only. Materials suitable for use in the ladder rungs include any conventional material known or used for ladder rungs. The presently preferred material is aluminum.

Similarly, interconnection of the stiles 20 and the rungs may be achieved by any means known in the art. For example, the rungs of the ladder may be held in the recesses 58 by any conventional means including tongue and groove, gluing, screwing, and riveting. In the presently preferred embodiment the rungs are held in place by screws.

The preferred method for producing the ladder stiles and ladders of the invention will now be discussed.

In the presently preferred embodiment the ladder stiles of the invention are forced by appropriately assembling a spacing portion, hardwood tension and compression portions and a fibreglass reinforcing rod.

To produce the softwood spacing portion sections, good quality pine timber is selected and dried to a moisture content of between substantially 10 to 12%. Spacing portion sections of substantially 40–50 mm in depth and substantially 20 mm in width are produced by rip sawing to the requisite dimensions.

These sections are then "defected". That is, unacceptable timber incorporating sap-products, areas of short grain, knots, pathological wood or other defects are cut out.

The resulting acceptable sections are machined to produce "fingered" ends so that successive lengths of section may be joined together by way of finger joints. The jointing may be carried out on a finger jointing machine, or failing this, by mounting the timber on a sliding carriage and passing the timber in front of a spinning cutter head mounted on a spindle.

A commercially available resorcinol glue (a mix of glue resin and hardener) is applied to the fingers and complementary fingers pressed together to form the finger joint. The jointing procedure is repeated until sections of a preselected length are produced.

Finally, these lengths of jointed core timber are machined to preselected cross section size through a multi-head moulding machine and the resultant product stored.

The hardwood tension and compression portions of the stile are formed from beech wood dried to a moisture content of between substantially 10 to 12%. This timber is rip sawed to a preselected cross section size of between substantially 18 to 25 mm in depth and substantially 36 mm in width. As with the softwood spacing portion sections the hardwood timber is then "defected" to produce timber lengths with a grain slope maximum of 1 in 12.

Selected ends of the timber are then cut at an angle to produce a length of timber having a one sided point with a slope of approximately 1 in 12. Scarf joints are produced by gluing complementary sloping lengths of timber together. A resorcinol glue is again used. The scarf joint is clamped or pressed to allow the glue to cure. The curing process may be accelerated through the application of heat. The scarf jointing procedure is repeated until a piece of timber of a preselected length is produced.

The resultant length of hardwood timber is machined or dressed to the preselected cross-section dimensions, through a multi-head moulding machine. As the timber passes through the moulding machine a reinforcing rod groove or grooves may also be machined into the length of timber. The finished hardwood edge is then stored.

Fibreglass reinforcing rod complying with any National safety standards specifications is obtained or cut to preselected lengths. The surface of the rod is abraded to remove wax and to provide a good key for the epoxy glue used to attach the fibreglass rod to the timber surface. The rod is also stored pending assembly of the ladder stile.

To assemble the stile a multiple lamination step is performed. Resorcinol and epoxy glues for lamination are prepared and applied to the timber, a plywood antisplit membrane and the reinforcing rod as appropriate. The stile is assembled with the plywood membrane disposed between two spacing portion sections, with the reinforcing rod in the purpose cut groove(s), and with the hardwood tension and compression portions disposed at either end of the assembled spacing portion. The stile as assembled is clamped together in a purpose built press. Sideways and edgeways pressure is applied using compressed air to clamp all joints tightly together.

Radio frequency induction heating is applied across the glue joints from the front face of the stile to the opposite face to heat the glue and accelerate the setting process. An average setting time is between 2 to 4 minutes when heated. The completed stile is then left to cool.

Once assembled and cooled the completed stile is passed through a multihead moulding machine in which the cross-section is sized, all faces and edges are smoothed, and corners rounded. The stiles are then trimmed to the exact pre-selected length. To complete the stile a number of finishing steps are effected. These steps may be carried out separately but sequentially or as part of an automated sequence. The finishing steps comprise:

1. Scalloping the outer faces of the spacing portion of the stile to remove material in a regular repeating pattern.
2. Sanding all of the stile faces except the ends.

3. Drilling rung receiving holes at points intermediate to those places from which material has been removed.
4. Drilling holes for rung securing screws.
5. Optionally, drilling holes for bolts, and machining trenches for fittings if required.
6. Branding or marking stile with information as to size, serial number, code if desired.
7. Optionally hardening the timber surrounding the rung-holes.
8. Coating stile with weather-proof coating.
9. Storing.

The ladders of the present invention are produced by interconnecting two ladder stiles of the invention with rungs.

The rungs are formed of extruded aluminum tubing incorporating grip-ridges. The tubing is cut to a preselected length, and the ends "spigoted" by machining off the grip ridges. Holes for receiving the rung securing screws are drilled through the rungs at the spigoted ends.

To assemble the ladder epoxy glue is applied to the rung recesses of the stile and the rungs inserted therein with the grip ridges orientated towards the top of the ladder. The assembled ladder is placed in a press and the rungs forced completely into the recesses to achieve a ladder of a preselected width. The rung securing screws are fastened into place with the heads of the screws lying below the surface of the timber of the stile. The ladder is removed from the press and stored flat and straight until the epoxy glue has set.

As a further step, where the ladder to be produced is an extension ladder, metal fittings such as brackets and arms, pulleys and rope are attached as for conventional extension ladders.

The following non-limiting examples are provided in order to illustrate the present invention and in no way limit the scope thereof.

Example One

Figure 1:
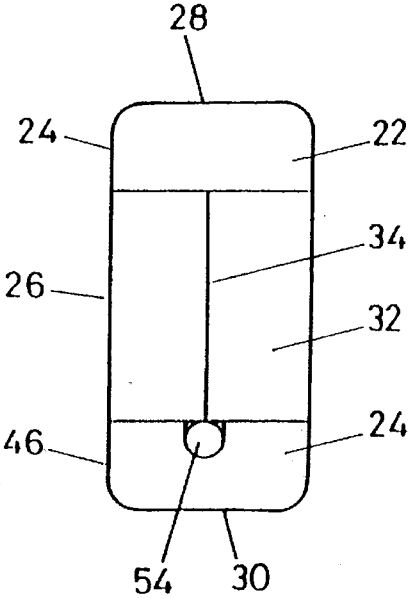
FIG. 1 is a cross section view of a first stile of the invention at a point where the entire spacing portion is the full width of the stile.
Figure 3:
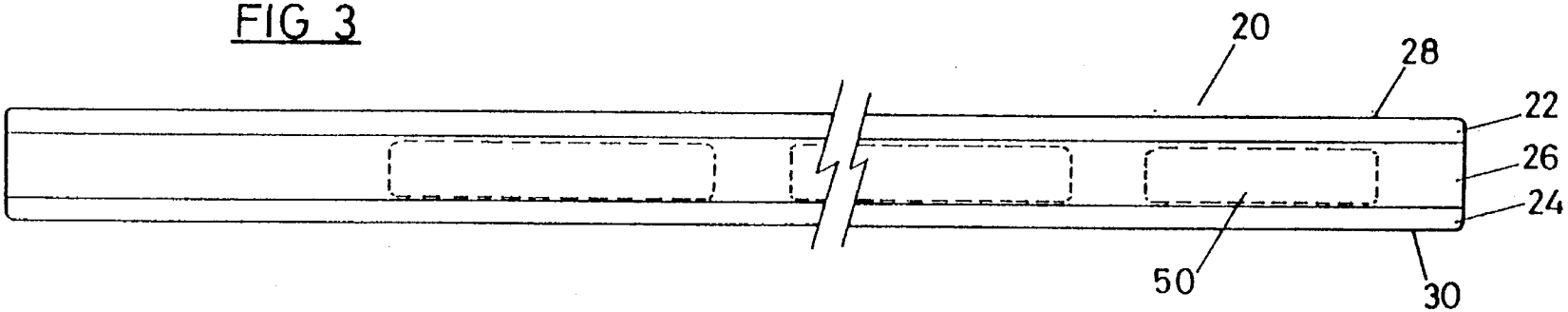
FIG. 3 is a side elevation of a stile of the invention.
Figure 4:
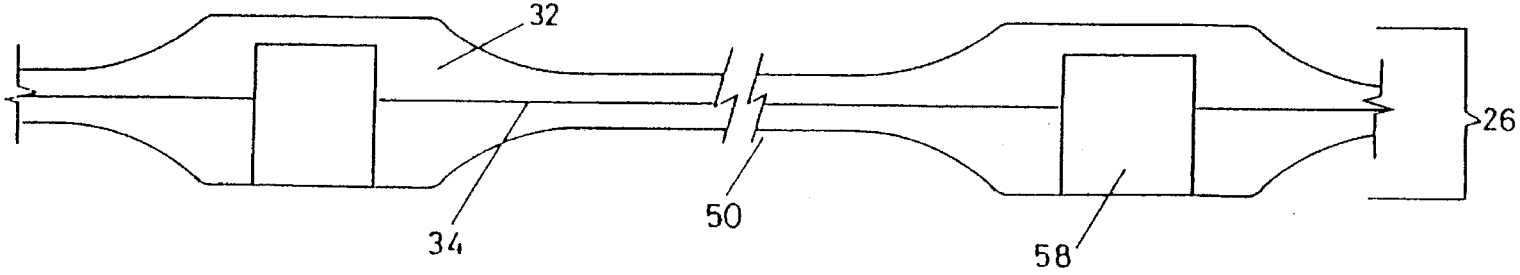
FIG. 4 is a longitudinal section through the spacing portion of a first stile of the invention.
Figure 7:
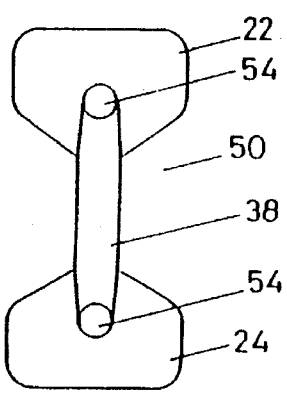
FIG. 7 is a cross section view of a third stile of the invention at a point where at least a part of the spacing portion is less than the full width of the stile.
Figure 6:
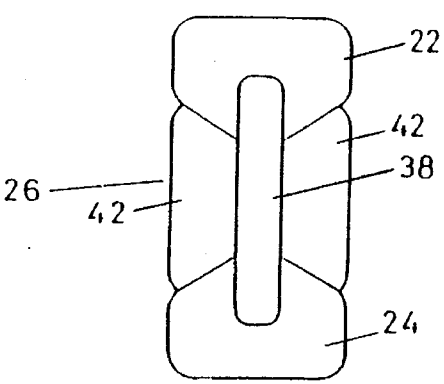
FIG. 6 is a cross section view of a third stile of the invention at a point where the entire spacing portion is the full width of the stile.

This embodiment requires the use of a hard, durable timber, such as beech or ash, in the stressed tension and compression portions of the ladder stile, laminated to a lighter timber such as pine or fir in the less stressed spacing portion. As shown in FIGS. 1, 2 and 4 the spacing portion is comprised of two sections connected along a central join. To provide a section wherein the width of the spacing portion is at least in part less than the entire width of the stile the material of the spacing portion has been machined away on both sides of the ladder stile to define two recesses as shown in FIG. 2. The removal of this material has very little effect on the strength of ladder stile as this portion of the ladder stile is non-stressed, yet at the same time the removal of this unneeded timber has a large effect on reducing the weight of the ladder stile. A corresponding ladder stile in which the spacing portion is the full width of the stile is shown in FIG. 1.

One possible penalty of the removal of the material is that the centre section of the ladder stile may be more prone to splitting along the centre line of the ladder stile. This design therefore embodies the feature of laminating two pieces of timber together to form the spacing portion of the ladder stile in order that the change in direction of timber fibres at the centre line will aid in reducing the tendency of the timber to split under stress.

This embodiment also incorporates the feature of reinforcing the tension portion with fibreglass, or a similar very strong composite rod running the full length of the ladder stile. Reinforcing material is used in the tension portion of the ladder stile as illustrated in FIGS. 1 and 2.

Example Two

This embodiment encompasses all the features of example one but has the additional feature that the splitting resistance of the spacing portion of the stile has been considerably enhanced by the use of a plywood antisplit membrane laminated between the two sections of the spacing portion as illustrated in FIG. 5.

Example Three

This embodiment, as will be appreciated from FIGS. 6 to 10 of the accompanying drawings, is a further development of examples one and two where the spacing portion is comprised of a single spacer and one or more packing means. In this embodiment the spacer is a length of plywood glued into the hardwood timber tension and compression portions. The packing means is glued in place or alternatively, as shown in FIG. 1 the packing means is bolted to the spacer.

This embodiment also incorporates all of the features of the previous two examples relating to the options for reinforcing the stile.

Example Four

Figure 11:
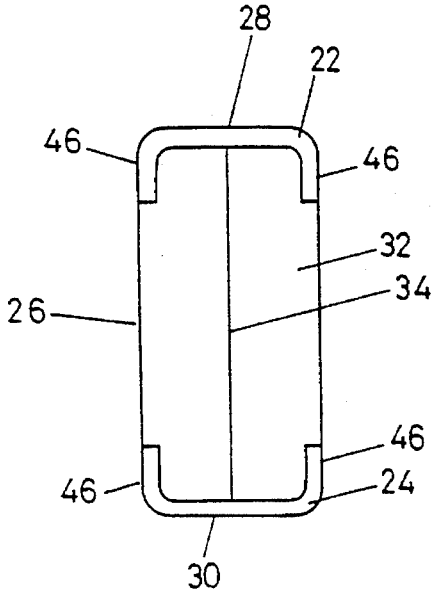
FIG. 11 is a cross section view of a fourth stile of the invention at a point where the entire spacing portion is the full width of the stile.
Figure 12:
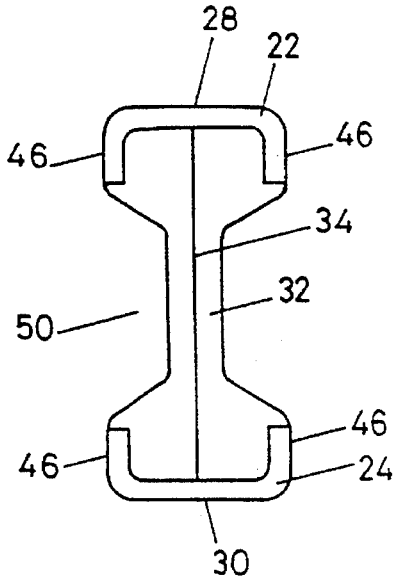
FIG. 12 is a cross section view of a fourth stile of the invention at a point where at least a part of the spacing portion is less than the full width of the stile.

This embodiment, illustrated in FIGS. 11 and 12 employs a fibreglass pultrusion or other suitable strong composite in the tension and compression portions of the ladder stiles. The pultrusion is laminated onto the lightweight spacing portion. The spacing portion in this example again comprises two sections of timber laminated together.

In this embodiment a resilient membrane is optionally laminated between the two sections of the spacing portion.

Generally, no additional composite or wire reinforcing is required with this embodiment, although such reinforcing may be employed if desired.

Example Five

Figure 13:
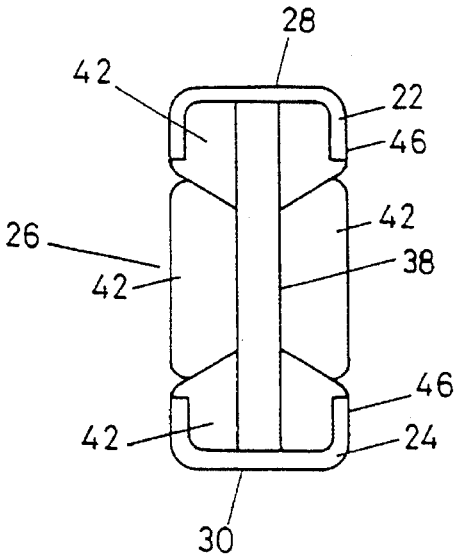
FIG. 13 is a cross section view of a fifth stile of the invention where the entire spacing portion is the full width of the stile.
Figure 14:
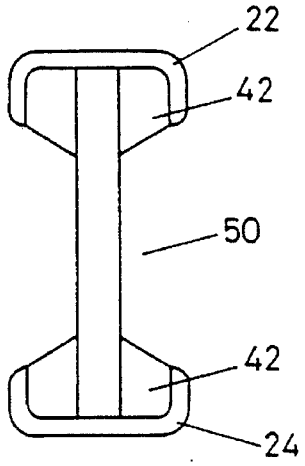
FIG. 14 is a cross section view of a fifth stile of the invention where at least a part of the spacing portion is less than the full width of the stile.

This embodiment shown in FIGS. 13 and 14 is a variation of example four incorporating the plywood spacer of example three. This embodiment incorporates plywood as a non-splittable, lightweight spacer in the spacing portion of the stile. The tension and compression portions are formed of a fibreglass pultrusion or other strong composite or timber. The spacer is conveniently glued to the stressed edges.

As with example three the spacing portion is also comprised of suitable, packing means. In this example the packing means comprises a number of different units made of different materials. The central packing unit is made from lightweight pine timber while the end units are of harder beech timber. The harder wood in the end packing units provides for better connection between the compression portions and the spacer of the spacing portion. While all of the parts of the stile are conveniently laminated together, the packing means may also be connected to the spacer by the method exemplified in FIG. 10.

Again reinforcing is optionally employed.

Example Six

This embodiment is similar to example three. Beech timber is used to form the tension and compression portions. As shown in FIGS. 15 and 16 the spacing portion comprises two spacers and a central body or packing means.

The cross-section of the spacing portion varies from the embodiment shown in FIG. 15 to an embodiment wherein the packing material is omitted from the spacing portion as illustrated in FIG. 16.

The recess formed from the omission of the packing material is desirably filled with a moisture excluding foam.

As with previous embodiments reinforcing may be used if desired.

Example Seven

This embodiment as shown in FIGS. 17 and 18 is similar to example 1. However, the tensions compression and spacing portions in this example are integrated sections of a single piece of timber rather than distinct portions joined together.

This embodiment also incorporates the feature of fibreglass reinforcing rod in both the tension and compression portions.

Thus, in accordance with the present invention there is provided a lightweight, nonconducting ladder stile and ladder incorporating the stiles of the invention. The advantage of the ladders and stiles is that they are designed to be non-conducting through judicious selection of materials, making them safe for use in areas where electricity may present a danger. A further advantage of the stiles and ladders of the invention is that they have a reduced weight achieved by eliminating or omitting material from the relatively unstressed spacing portion of the stile at selected sections and essentially between the points of attachment for the ladder rungs. Further, in the ladders and stile of the invention, the overall weight is significantly reduced without compromising the structural integrity of the stile or any ladder in which it is to be used. The employment of this invention enables stiles of greater depth to be built which are lighter in weight than traditional timber ladders. Moreover, these stiles of greater depth are stiffer and stronger without the previous weight penalty.

Moreover, use of a combination of materials selected according to the stress factors of the ladder stile portions provides ladder stiles which are at once stronger, more hard wearing, and less prone to production of splinters at sites of damage than conventional timber ladder stiles while still retaining the advantage of being substantially lighter in weight.

An emphasis on the use of New Zealand timbers such as high quality, strong, native beech, of which there is an abundant supply, in combination with light weight pine timber which is also in plentiful supply avoids the difficulty of diminishing supply of traditional materials. Further, use of a dark coloured beech wood, in combination with lighter coloured pine timber provides a ladder stile which is a very aesthetically pleasing arrangement.

The inclusion of reinforcing material provides for an increase in the strength and stiffness of the ladder stile as well as acting as a safety. The ladders of the present invention which incorporate the reinforcing material at a point internal of the stile provide considerable advantages over conventional ladders. When the reinforcing material is in an internal position, it is protected from wear and damage and can not "unzip" as in the case of conventional ladders. Further, when wire reinforcing is used in an internal position the ladder ceases to be a danger to users in the electricity industry where exposed wires can conduct electricity to the users hand.

Both the ladder stiles and ladders of the present invention may also incorporate such optional features as protective guards over the ends of the ladder stiles, and means for attaching fittings to the ladder stile including brackets and arms required for extension ladders. Further, the stiles and ladders may be protectively coated, treated, painted or otherwise embellished, if desired.

It will be appreciated by those persons skilled in the art that the above description is provided by way of example only and that the invention is limited only by the lawful scope of the appended claims.

What is claimed is:

1. A stile for a ladder comprising:

a separate and discrete compression portion bearing a compression edge and having a substantially uniform cross-section over the length of the stile, the compression portion having a longitudinal centerline along the entire length of the stile, a separate and discrete tension portion bearing a tension edge and having a substantially uniform cross-section over the length of the stile, the tension portion having a longitudinal centerline along the entire length of the stile, said compression and tension portions being spaced apart at a substantially constant distance over the length of the stile, and wherein said compression and tension edges define the width of the stile, and a separate and discrete spacing portion structurally interconnecting said compression and tension portions along lines parallel to their longitudinal centerlines along substantially the entire length of the stile and having a cross-section which varies over the length of the stile between sections where the entire spacing portion is the full width of the stile and sections where at least part of the spacing portion is less than the full width of the stile, the variations in cross-section of the spacing portion occurring in a substantially regular repeating pattern over the length of the stile, and wherein the spacing portion comprises two sections with a resilient membrane laminated between the two sections, wherein each of said separate and discrete compression, tension, and spacing portions are formed from timber, and the stile is substantially rectangular in plan.

2. A stile as claimed in claim 1 wherein a fiberglass reinforcing rod is included in the tension portion of the stile.

3. A ladder comprising a pair of parallel stiles interconnected by rungs, wherein each stile comprises:

a separate and discrete compression portion bearing a compression edge and having a substantially uniform cross-section over the length of the stile, the compression portion having a longitudinal centerline along the entire length of the stile, a separate and discrete tension portion bearing a tension edge and having a substantially uniform cross-section over the length of the stile, the tension portion having a longitudinal centerline along the entire length of the stile, said compression and tension portions being spaced apart at a substantially constant distance over the length of the stile, and wherein said compression and tension edges define the width of the stile, and a separate and discrete spacing portion structurally interconnecting said compression and tension portions along lines parallel to their longitudinal centerlines along substantially the entire length of the stile and having a cross-section which varies over the length of the stile between sections where the entire spacing portion is the full width of the stile and sections where at least part of the spacing portion is less than the full width of the stile, wherein each of said separate and discrete compression, tension, and spacing portions are formed from timber.

4. A ladder as claimed in claim 3 wherein the stile is substantially rectangular in plan.

5. A ladder as claimed in claim 2 wherein the variations in cross-section of the spacing portion occur in a substantially regular repeating pattern over the length of the stile.

6. A ladder as claimed in claim 2 wherein the spacing portion comprises two sections.

7. A ladder as claimed in claim 3 further comprising a resilient membrane laminated between the two sections of the spacing portion.

8. A ladder as claimed in claim 7 wherein a fiberglass reinforcing rod is included in the tension portion of the stile.

* * * * *